US006971785B2

(12) United States Patent
Murphy et al.

(10) Patent No.: US 6,971,785 B2
(45) Date of Patent: Dec. 6, 2005

(54) CANISTER ASSEMBLY FOR POWDER DELIVERY SYSTEM

(75) Inventors: Christopher M. Murphy, Sterling Heights, MI (US); Sheila Farrokhalaee Kia, Bloomfield Hills, MI (US); Gunnar Van Der Steur, Chesapeake City, MD (US); Jeffrey A. Wallace, Street, MD (US)

(73) Assignee: General Motors Corporation, Detroit, MI (US)

( * ) Notice: Subject to any disclaimer, the term of this patent is extended or adjusted under 35 U.S.C. 154(b) by 194 days.

(21) Appl. No.: 10/621,187

(22) Filed: Jul. 16, 2003

(65) Prior Publication Data

US 2005/0013193 A1 Jan. 20, 2005

(51) Int. Cl.[7] ..... B01F 13/02

(52) U.S. Cl. ..... 366/107; 366/182.4; 366/191; 118/612; 239/143

(58) Field of Search ..... 366/101, 107, 366/143, 163.2, 182.4, 191; 422/139, 143, 422/145; 239/143; 118/612

(56) References Cited

U.S. PATENT DOCUMENTS

| | | | | |
|---|---|---|---|---|
| 2,586,818 | A * | 2/1952 | Harms | 209/474 |
| 2,886,899 | A * | 5/1959 | Watkins | 34/576 |
| 3,873,024 | A * | 3/1975 | Probst et al. | 239/704 |
| 4,248,379 | A * | 2/1981 | Hollstein et al. | 239/1 |
| 4,586,854 | A | 5/1986 | Newman et al. | 406/153 |
| 4,640,310 | A * | 2/1987 | Hartle et al. | 137/883 |
| 5,186,388 | A * | 2/1993 | Chapman et al. | 239/8 |
| 5,891,401 | A * | 4/1999 | D'Acierno et al. | 422/143 |
| 5,915,621 | A * | 6/1999 | Yanagida et al. | 239/3 |
| 5,928,423 | A | 7/1999 | Toyota et al. | 118/308 |
| 6,705,545 | B1 * | 3/2004 | Sroka et al. | 239/112 |
| 2001/0003351 | A1 * | 6/2001 | Chen et al. | 239/124 |
| 2002/0139301 | A1 * | 10/2002 | Attinoto et al. | 118/308 |

* cited by examiner

*Primary Examiner*—David Sorkin

(74) *Attorney, Agent, or Firm*—Laura C. Hargitt

(57) ABSTRACT

A powder paint canister assembly includes a canister body having a color changer manifold, a purge ring, and at least one venturi pump attached thereto. The canister body interior includes a fluidization plate and a fluidization distribution plate adjacent a preferably oval inlet to the venturi pump for supplying powder material from the canister. The color changer manifold includes a plurality of manifold modules each having two pinch valve assemblies with quick disconnect inlet fittings for supplying powders of different colors. The purge air ring supplies purge air to the canister through a plurality of apertures of different orientations.

24 Claims, 5 Drawing Sheets

CANISTER ASSEMBLY FOR POWDER DELIVERY SYSTEM

BACKGROUND OF THE INVENTION

The present invention relates in general to powder paint transfer and distribution systems for use with powder coating applicators and, in particular, to a canister assembly for a powder delivery or distribution system.

In prior art powder paint transfer and distribution systems, the powder paint is unloaded from a tote bulk storage system by a vacuum transport directly to a receiver. Alternatively, the powder paint is gravity fed from a bag bulk storage system into a vacuum stream. The unloaded powder in the receiver is then conditioned utilizing a sieve and gravity fed to a primary fluidized hopper. The powder paint is transferred from the primary hopper to a secondary fluidized hopper located approximately 25 feet from the point of application. The powder paint is fed from the secondary hopper or hoppers to the applicators. Disadvantageously, one complete distribution system that includes the bulk storage, sieve, primary hopper and secondary hopper is needed for each color of powder to be sprayed. Typically, one secondary hopper can supply six applicators, also a third level of hoppers is added for cut-ins and supplemental robotic application. Typically, there is one hopper per color of powder connected to each robot. This system requires that each color of powder have a series of hoppers, so that each color added to the system increases the number of primary, secondary, and robot hoppers required in the system. A venturi pumping system is used to transfer the powder paint material between the hoppers and the applicator. For example, a three color color-keyed and ten color color-specific system requires ten to thirteen primary hoppers, fifty to sixty secondary and/or robot hoppers, over one hundred fifty venturi pumps, and over twenty color changers.

A recent and innovative apparatus and system has been introduced that simplifies and improves upon the prior art powder paint transfer and distribution system by eliminating the multitude of main feed hoppers, secondary hoppers, and color changers in the prior art systems noted above. The powder distribution system is described in detail in the U.S. patent application Ser. No. 10/400,830, filed Mar. 27, 2003, entitled "Canister Powder Paint Delivery Apparatus And Method" which application is incorporated herein by reference.

It is desirable to provide canister assemblies for a powder paint transfer and distribution system as described above that allow the system to be operated and maintained both efficiently and cost-effectively.

SUMMARY OF THE INVENTION

The present invention concerns a canister assembly for use in a powder paint transfer and distribution system. The canister assembly includes a canister body having a color changer manifold, a purge ring, and at least one venturi pump manifold attached thereto. At least one inspection window may be provided for viewing an interior of the canister body. The canister body interior includes a fluidization plate, a fluidization distribution plate, and a preferably oval venturi pump inlet disposed therein. The color changer manifold includes a plurality of pinch valve assemblies each having quick disconnect inlet fittings, a swivel mounted air fitting, and a purge air fitting.

The canister assembly in accordance with the present invention will advantageously improve the operation of a powder paint transfer and distribution system, especially for multi colored powder systems. The present invention may also be utilized in other applications including, but not limited to, single color powder application, robotic powder application, powder clear coat application, or any other powder application.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
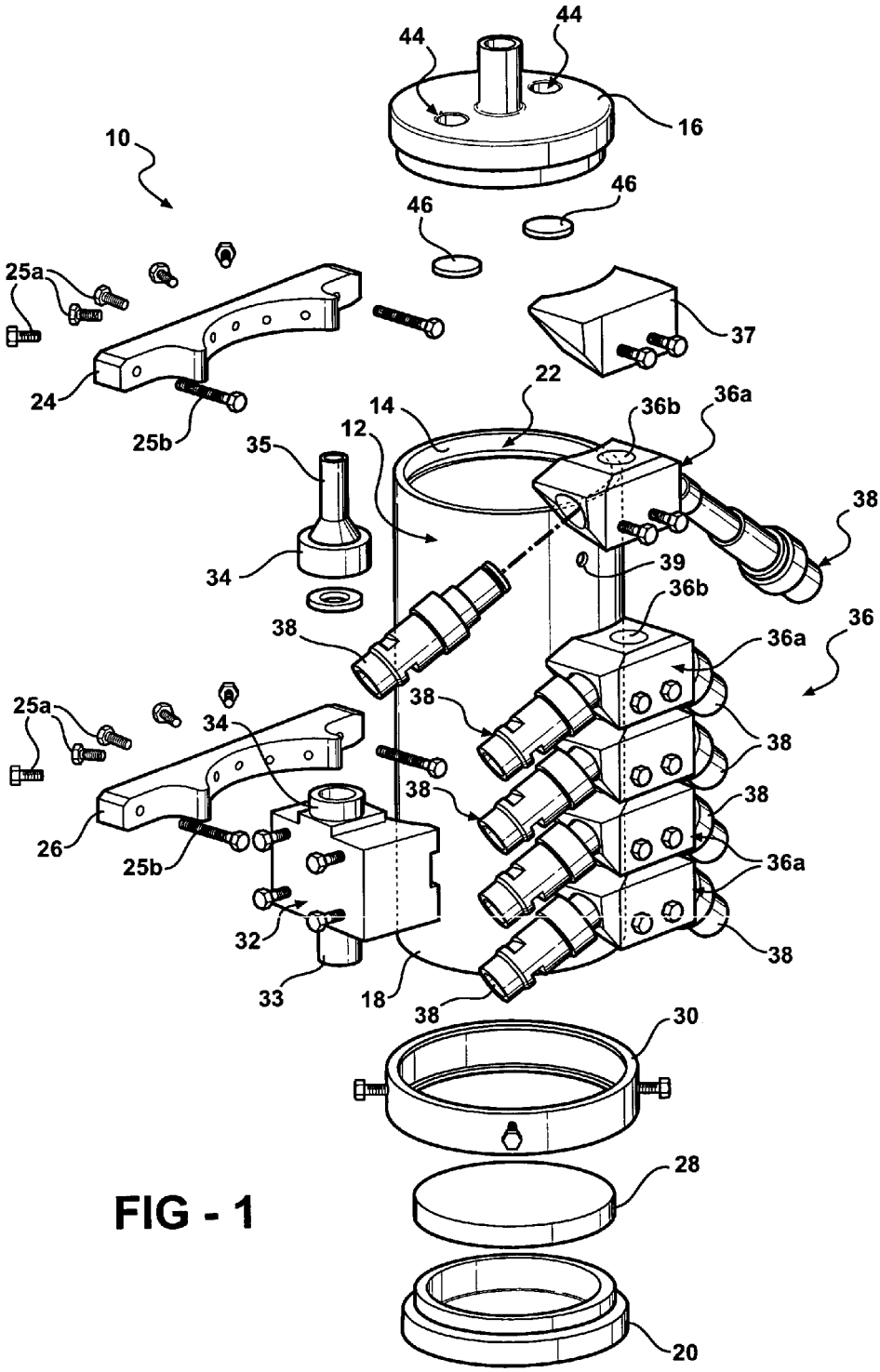
FIG. 1 is a exploded perspective view of a canister, a venturi pump assembly, and a color changer manifold for use in a powder paint transfer and distribution system in accordance with the present invention.
Figure 3:
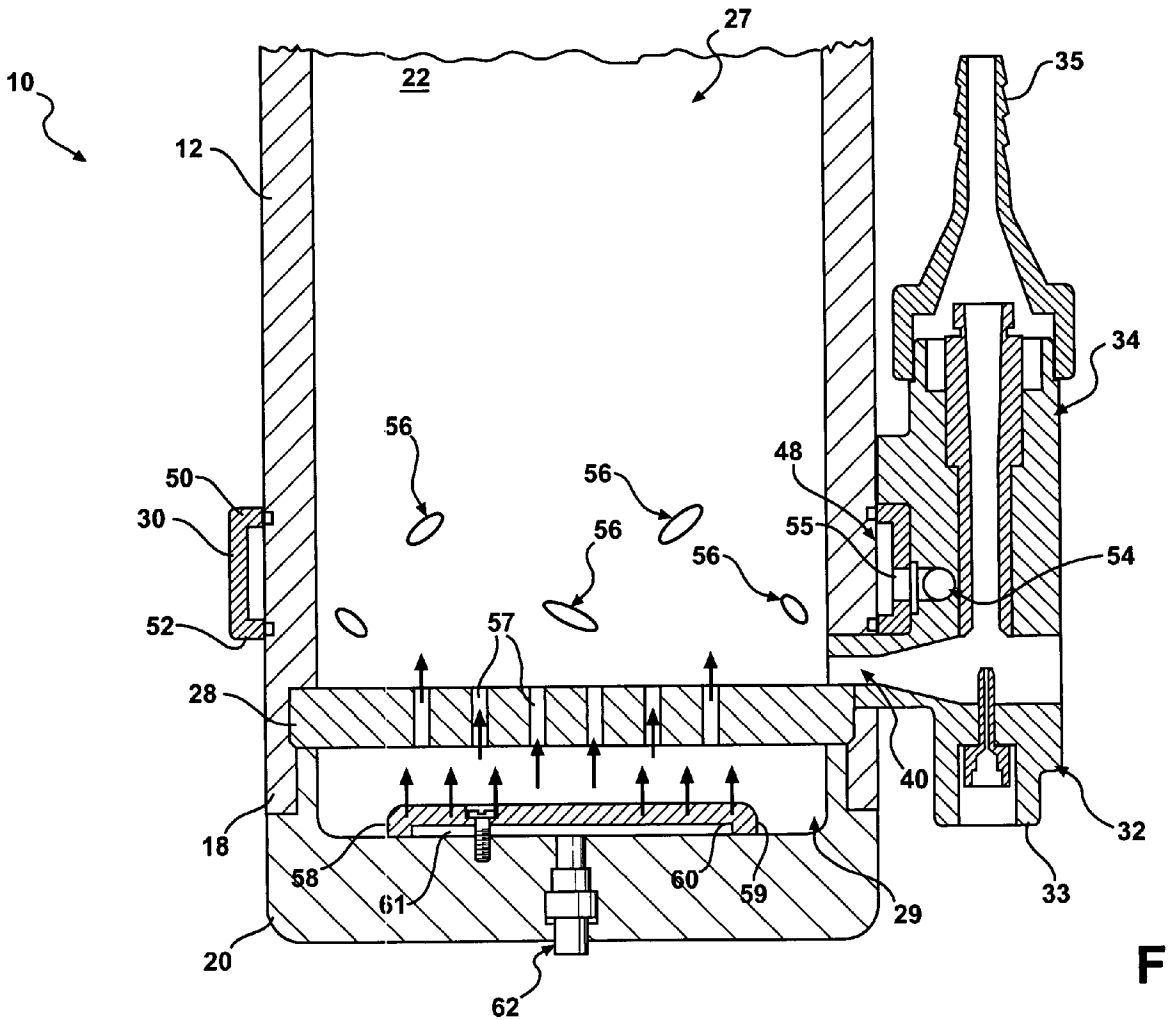
FIG. 3 is a fragmentary cross-sectional view of the canister and the venturi pump assembly of FIG. 2.
Figure 5:
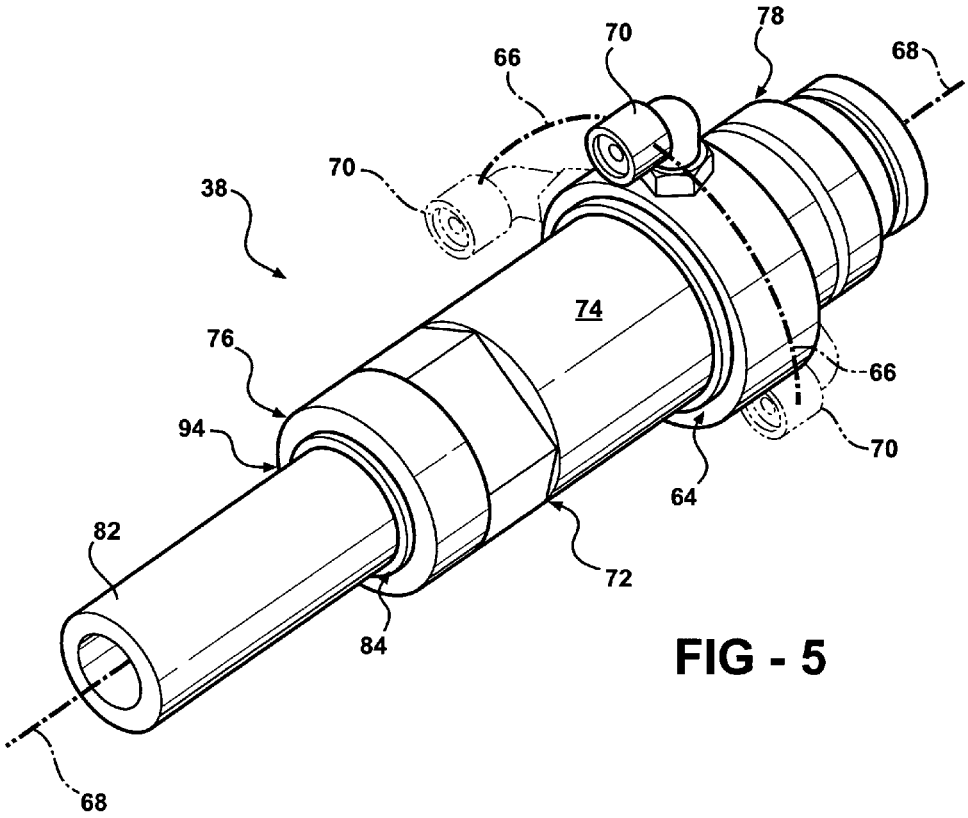
FIG. 5 is a perspective view of a powder inlet valve assembly in accordance with the present invention.
Figure 8:
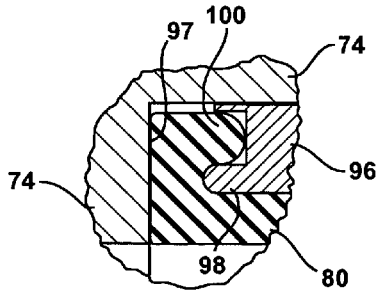
FIG. 8 is a cross-sectional view in an enlarged scale of the encircled portion 8 of FIG. 6.

Referring now to FIG. 1, a canister assembly for use in a powder paint transfer and distribution system in accordance with the present invention is indicated generally at 10 and is shown in exploded view. The canister assembly 10 includes a canister body 12. Preferably, the canister body 12 is generally cylindrical and substantially hollow. Alternatively, the canister body 12 is formed of any other shape that is advantageous for storing powder paint in an interior portion thereof. An upper end 14 of the canister body 12 is closed by an upper plate 16 and a lower end 18 of the canister body 12 is closed by a lower plate 20, defining an enclosed plenum portion 22 in the interior of the hollow canister body 12. An upper mounting bracket 24 and a lower mounting bracket 26 are operable to attach the canister body 12 to a mounting location (not shown) by a plurality of fasteners or the like. The brackets 24 and 26 are attached to an exterior surface of the canister body 12 by a plurality of threaded attachment fasteners 25*a* extending through associated apertures formed in the brackets. The brackets 24 and 26 can be attached to a suitable mounting surface (not shown) by mounting fasteners 25*b* extending through associated apertures formed in the brackets. A porous fluidizing plate 28, discussed in more detail below, is disposed in the plenum portion 22 of the canister body 12 adjacent the lower plate 20. As shown in FIG. 3, the plate 28 extends the full internal diameter of the canister body 12 dividing the plenum 22 into an upper powder paint storage portion and a lower fluidization air plenum 29. A purge ring 30, discussed in more detail below, is mounted on an exterior surface of the canister body 12 adjacent the lower plate 20.

A venturi manifold assembly 32 is mounted on the exterior surface of the canister body 12. The assembly 32 functions as a venturi pump having a pressured fluid inlet 33 and an outlet 34. Alternatively, the venturi manifold assembly 32 is not mounted on the canister body 12. Alternatively, the canister assembly 10 includes a plurality of venturi pumps or any other suitable powder material transfer means including, but not limited to, dense phase transfer pumps. The inlet 33 is in fluid communication with a source of pressurized fluid (not shown), such as compressed air or the like, for operating the venturi pump. A hose fitting 35 is attached to the outlet 34 for connection to a hose (not shown) leading to the powder paint applicator. The venturi pump draws powder paint material from the plenum portion 22 as discussed below.

A modular powder color changer manifold 36, formed from a plurality of dual manifold module bodies 36*a*, is mounted on the exterior surface of the canister body 12. The module bodies 36*a* are stacked vertically and the manifold 36 is topped by an end cap 37 abutting an upper surface of the uppermost body 36*a*. Each of the module bodies 36*a* receives a pair of pinch valve assemblies 38, discussed in more detail below. Preferably, each of the valve assemblies 38 is connected to a powder supply of a different color of powder paint. A passage 36*b* is formed in each of the bodies 36*a* extending between the upper and lower surfaces and communicating with the associated valves 38. The passage 36*b* can connect at a lower end to an upper end of the passage of a downstream one of the module bodies 36*a*. The passage 36*b* can connect at an upper end to a lower end of the passage of an upstream one of the module bodies 36*a* or a fluid component such as the canister body 12. The end cap 37 connects the upper end of the passage 36*b* of the uppermost manifold body 36*a* to a plenum inlet 39 formed in the wall of the canister body 12 while the lower end of the passage 36*b* in the lowermost body 36*a* is blocked (not shown). In an alternative embodiment (not shown), the powder manifold 36 is located remotely from the canister body 12 and the passages are connected to the plenum inlet 39 by at least one conduit. When located remotely, the powder manifold 36 may be utilized to supply more than one canister body, such as the canister body 12.

A control system (not shown) for the powder changer manifold 36 is operated to actuate a selected one of the pinch inlet valve assemblies 38 to fill the canister 12, discussed in more detail below. As shown in FIG. 1, the powder manifold 36 includes five manifold bodies 36*a* having a total of ten pinch valve assemblies 38. Those skilled in the art, however, will appreciate that the powder manifold 36, along with the canister 12, may be constructed to utilize any number of pinch valve assemblies 38. For example, if twenty colors were required, the canister 12 can be made of a greater length and five more manifold module bodies 36*a* added, i.e. the manifold module bodies 36*a* could be "piggy-backed" so that one manifold module body 36*a* is attached directly on top of the other or, just as effectively, an additional powder manifold, such as the powder manifold 36, can be mounted on the exterior surface of the canister 12 to accommodate the additional color requirements.

Figure 2:
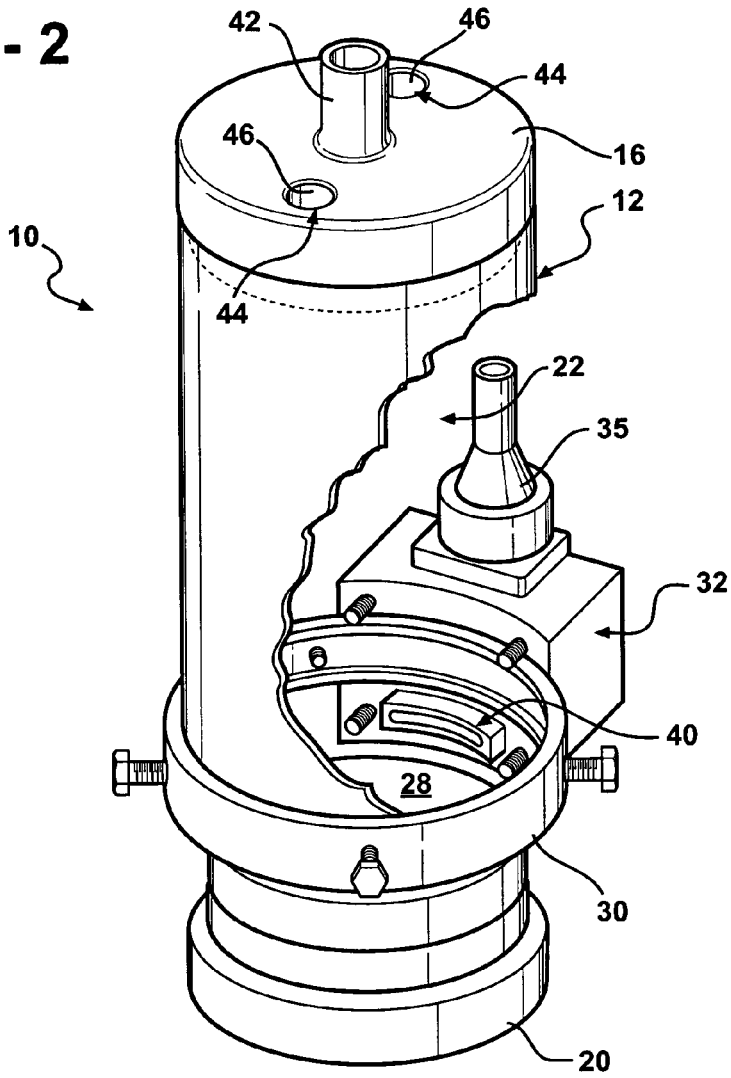
FIG. 2 is a partial cut away perspective view of the canister of FIG. 1 shown with an assembled venturi pump.

Referring now to FIG. 2, an inlet opening 40 for the venturi pump 32 is shown extending through a wall of the canister body 12 adjacent an upper surface of the fluidizing plate 28. The inlet opening 40 is preferably generally oval in shape, which will advantageously allow for a greater amount of powder material (not shown) to be suctioned from the canister plenum 22 without the powder buildup that disadvantageously occurs when the powder material exits the canister plenum 22 through a generally round opening, as in the prior art. Alternatively, the inlet opening 40 is not oval in shape but can be sized, shaped, or oriented to accommodate any powder material transfer means including, but not limited to, dense phase transfer pumps.

Referring now to FIGS. 1 and 2, the upper plate 16 is preferably conical in shape and includes a purge air outlet 42 extending therethrough for providing an exhaust for pressurized purge air from the canister plenum 22 during a purging operation, discussed in more detail below. The size and shape of the upper plate 16 and the purge air outlet 42, however, may vary and is determined by the process in which the canister assembly 10 is to be used. Also, the purge air outlet 42 can be placed at other locations in the canister body 12. The upper plate 16 includes a pair of apertures 44 formed therethrough. Each of the apertures 44 receives a sight glass 46 therein. Each of the sight glasses 46 is preferably formed of a transparent material including, but not limited to, sapphire glass or the like. The sight glasses 46 aid in allowing operating personnel to view the condition of the canister plenum 22 during operation of the canister 12 and the powder paint transfer and distribution system without requiring the removal of the upper plate 16. Thus, an operator can use the sight glasses 46 to quickly inspect the inner surfaces of the canister body 12 and the upper plate 16 for powder build-up and impact fusion.

Referring now to FIG. 3, the canister 12 and venturi manifold assembly 32 are shown assembled and in cross section. The fluidizing plate 28, when installed, separates the interior plenum portion 22 of the canister body 12 into the lower fluidization air plenum 29 and the upper powder paint material storage portion 27. The purge ring 30 has a generally U-shaped profile and is mounted to the exterior surface of the canister 12 to define a purge air gap or chamber 48 between an upper leg or flange 50 and a lower leg or flange 52 thereof. The purge air chamber 48 is supplied with a pressurized fluid, preferably compressed air or the like, through a supply conduit 54 formed in the venturi manifold assembly 32 and aligned with an inlet 55 of the ring 30. A plurality of purge air apertures 56 extend through the wall of the canister body 12 adjacent the gap formed by the purge ring 30. The purge air apertures 56 are preferably oriented to provide as much agitation in the canister plenum 22 as possible, such as by varying the axes of the apertures vertically and/or horizontally with respect to a longitudinal axis of the canister 12.

In the embodiment shown, a total of ten of the purge air apertures 56 (five of which apertures 56 are shown in the cross section of FIG. 3) are provided, with five of the apertures 56 oriented downwardly directing the purge air towards the fluidizing plate 28. The other five apertures 56 are oriented upwardly directing the purge air towards the upper plate 16. Preferably, the apertures 56 are formed such that the purge air enters the canister plenum 22 tangential to the inner wall and alternate in orientation, i.e. oriented upwardly, oriented downwardly, oriented upwardly, etc. Although ten apertures 56 are described, the canister 12 may be modified for more or less apertures 56, situated at any location and orientation.

When changing from a first paint color in the powder delivery system according to the present invention, the canister 12 needs to be emptied and filled with the second color powder material. To accomplish this, a purging operation is commenced by introducing compressed air into the supply conduit 54 such as by the control system opening a valve (not shown) upstream of the supply conduit 54. The compressed air flows through the inlet 55 into purge air chamber 48 and through the apertures 56 into the canister 12 to agitate the contents of the plenum portion 22. As the contents of the canister plenum 22 are agitated, a valve (not shown) that is located downstream of the purge air outlet 42 is opened, allowing the contents of the canister plenum 22 and the compressed air from the purge air gap 48 to exhaust through the purge air outlet 42. Preferably, the compressed air is routed from the purge air gap 48 and into the canister plenum 22 for a predetermined time interval to exhaust the canister plenum 22 completely of any residual powder paint material.

Figure 4:
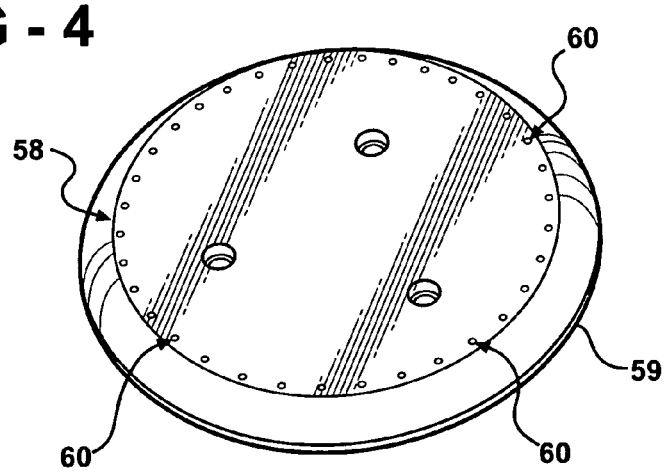
FIG. 4 is a perspective view of a fluidizing distribution plate in accordance with the present invention.

The porous fluidizing plate 28 is disposed in a lower portion of the canister body 12 and includes a plurality of fluidizing apertures 57 extending therethrough. A fluidizing distribution plate 58 is disposed intermediate the lower plate 20 and the fluidizing plate 28 and is mounted on an upper surface of the lower plate 20. The fluidizing distribution plate 58 is smaller in diameter than the inner diameter of the canister body 12 and includes a downwardly extending peripheral flange 59 that spaces the plate 58 above the surface of the plate 20. A plurality of holes 60 extend through the plate 58 adjacent the flange 59 in a circular pattern, best seen in FIG. 4. A fluidizing air chamber 61 is formed between the lower surface of the plate 58 and the upper surface of the plate 20. A fluidizing air inlet 62 extends through the lower plate 20 to communicate with the chamber 61. The fluidizing air inlet 62 is connected to a fluidizing air supply (not shown), such as source of compressed air or the like. Alternatively, the canister body 12 is connected to other types of means for mixing or agitating the paint powder material including, but not limited to, an external or internal source of vibration, an internal inlet for providing compressed air, or any other type of system operable to mix or agitate the paint powder material for subsequent delivery downstream of the paint canister body 12.

During operation of the powder delivery system and when the canister 12 is supplying powder paint material to the applicator, compressed fluidizing air is supplied to the fluidizing air inlet 62. The fluidizing air flows from the inlet 62 into the chamber 61, through the holes 60 formed in the fluidizing distribution plate 58 to the fluidization air plenum 29, and to the lower surface of the fluidizing plate 28. The fluidizing distribution plate 58 distributes the fluidizing air more uniformly through the apertures 60 so as not to concentrate a jet of air onto the center of the fluidizing plate 28, and advantageously yields a more uniform fluidized bed for the powder paint material.

Referring now to FIGS. 5–8, each of the pinch valve assemblies 38 includes a collar member 64 that is rotatably mounted on an exterior of a tubular pinch valve body 74. The collar member 64 includes a fitting 70 extending therefrom for attachment to a conduit (not shown), such as a flexible hose or the like, which is in turn connected to a source of pressurized fluid such as compressed air or the like. The collar member 64 is operable to be rotated 360 degrees about a longitudinal axis 68 of the valve assembly 38, best seen in FIG. 5, such that the fitting 70 travels along a circular path 66 about the body 74. The collar member 64 allows a flexible hose to be attached to the fitting 70 at any angular position about the longitudinal axis 68 of the valve assembly 38, which is particularly advantageous when a plurality of valve assemblies 38 and their respective fittings 70 are assembled and located adjacent one another as in the powder change manifold 36. The fitting 70 is adapted to supply the compressed air through an internal passage 71 to a pinch valve, indicated generally at 72. The pinch valve 72 includes the valve body 74 having an inlet portion 76, an outlet portion 78, and a flexible membrane member 80 disposed in an interior portion of the valve body 74.

The inlet portion 76 of the pinch valve 72 is adapted to be releasably attached to an inlet conduit 82 by a push lock fitting 84. The inlet conduit 82 is preferably formed of a flexible material including, but not limited to, plastic tubing or the like similar to the flexible hose attached to the fitting 70. The inlet conduit 82 is in fluid communication with a source (not shown) of powder paint material. The push lock fitting 84 includes an annular base portion 86 having a retaining flange portion 88 extending therefrom for retaining the inlet conduit 82 to the pinch valve inlet portion 76. The base portion 86 is adapted to be fixedly attached to an exterior surface of the inlet conduit 82. The retaining flange portion 88 includes a projection 90 for releasably engaging with a flange portion 92 on an interior diameter of the inlet 76. The flange portion 92 is formed between a larger internal diameter intermediate portion 93 and a smaller internal diameter open end 94.

When the push lock fitting 84 is inserted into the open end 94 of the inlet portion 76, the retaining flange portion 88 and projection 90 deflect radially inwardly to pass through the opening. After passing through the opening 94, the retaining flange portion 88 springs back to engage the projection 90 with the flange portion 92 and retain the inlet conduit 82 and push lock fitting 84 in the valve body 74. Similarly, when a force is applied to deflect the flange portion 88 inwardly, the push lock fitting 84 can be removed from the opening 94. The push lock fitting 84 retains the inlet conduit 82 to the valve assembly 72. An O-ring 95 is disposed in intermediate portion 93 of the valve body 74 to seal the conduit 82 to the valve body 74. Alternatively, the retaining flange portion 88 is a plurality of leg members (not shown) extending from the base portion 86.

The tubular membrane member 80 is disposed in the interior of the valve body 74 and is retained by a surrounding tubular retaining collar 96. The retaining collar 96 is preferably formed of a rigid material, such as steel or the like. Prior to being inserted into the valve body 74, the membrane member 80 is inserted into the retaining collar 96. At each end of the assembled membrane member 80 and retaining collar 96, a flange 98 of the retaining collar 96 cooperates with a lip 100 of the membrane member 80, best seen in FIG. 8. When the assembled membrane member 80 and retaining collar 96 are placed in the valve body 74 and a purging spool 102 is press fit into an opening 79 of the outlet portion 78, the membrane member 80 is restricted from radial or lateral movement by a radial edge 97 of the valve body 74 and a corresponding radial edge (not shown) of the purging spool 102, which advantageously reduces or eliminates membrane member 80 blowout that is common in the prior art. The purging spool 102 includes an annular channel 103 formed in an exterior surface thereof, which is supplied air through an interior air channel (not shown) in each manifold body 36*a*. The spool 102 includes apertures 104 formed therein adjacent the channel 103 for providing compressed air for purging the powder material flow path in the interior of the valve body 74. The retaining collar 96 includes an external annular channel 105 with a plurality of apertures 106 formed through the wall of the collar to place the passage 71 of the fitting 70 in fluid communication with the exterior surface of the membrane 80.

Figure 6:
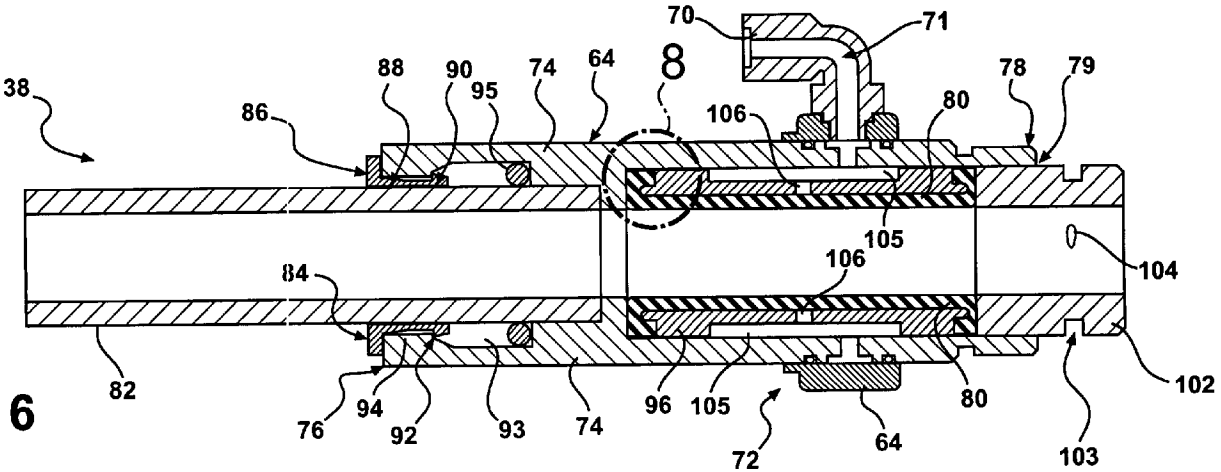
FIG. 6 is a cross-sectional view of the powder inlet valve assembly of FIG. 5 shown in a valve open position.
Figure 7:
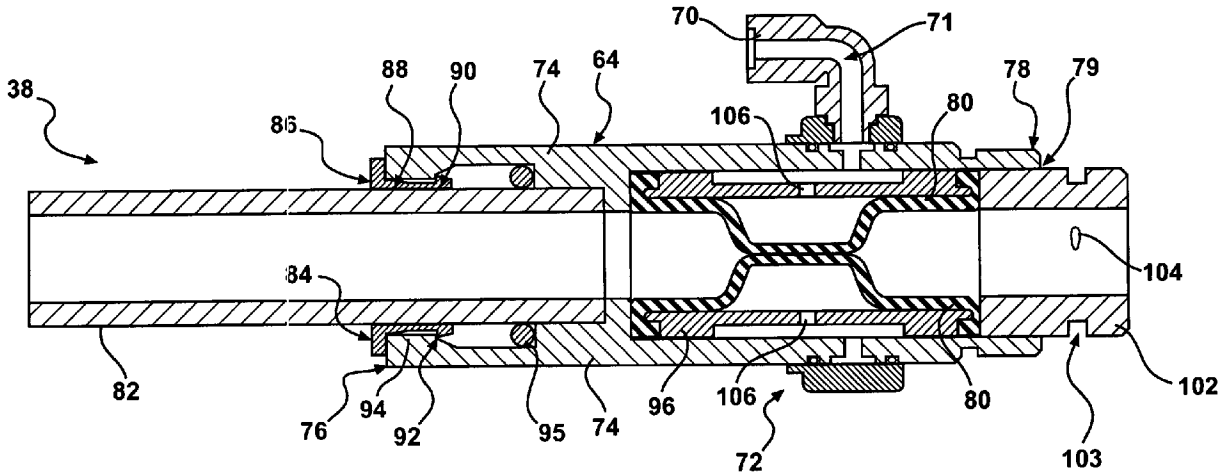
FIG. 7 is a cross-sectional view of the powder inlet valve assembly of FIG. 5 shown in a valve closed position.

During operation of the powder delivery system and when the canister 12 is supplying powder paint material to the applicator, the valve assembly 38 for the appropriate color powder paint material is in the valve open mode as shown in FIG. 6. Thus, powder can flow from the supply through the conduit 82, through the pinch valve 72 and into the manifold body 36*a* from the outlet portion 78. The valve assemblies 38 that are not supplying the current color powder paint material are in the valve closed mode as shown in FIG. 7. To place the pinch valve 72 in the valve closed mode, the control system provides a signal, for example, to a solenoid valve (not shown), which in turn supplies the compressed air to the fitting 70 of the collar member 64. The compressed air flow into the channel 105 and is routed through the apertures 106 in the retaining collar 96, which provides a pressure on the exterior surface of the flexible material of the membrane member 80, forcing the membrane member 80 to deform to the valve closed mode of FIG. 7. In the valve closed mode, the membrane member 80 prevents flow of the powder paint material from the inlet portion 76 to the outlet portion 78. The pinch valve 72 can be opened by exhausting the air pressure on the membrane member 80.

In accordance with the provisions of the patent statutes, the present invention has been described in what is considered to represent its preferred embodiment. However, it should be noted that the invention can be practiced otherwise than as specifically illustrated and described without departing from its spirit or scope. For example, while the present invention has been described in terms of a powder paint material delivery and distribution system, those skilled in the art will appreciate that the present invention and, in particular, the color changer manifold, may be utilized with other types of material or fluid transfer, distribution, or delivery systems such as single color powder application, robotic powder application, powder clear coat application, or any other powder application.

What is claimed is:

1. A canister assembly for a powder paint material delivery and distribution system, comprising:

a substantially hollow closed canister body defining a plenum and having a powder paint material inlet formed through a wall thereof for receiving powder paint material from a source, said wall including a plurality of purge air apertures formed therethrough, said plurality of purge air apertures being oriented in different axial directions with respect to a longitudinal axis of said canister body with at least one of said apertures extending along an axis angled with respect to both said longitudinal axis of said canister body and a plane transverse to said longitudinal axis;

means for mixing the powder paint material in the plenum;

at least one powder material transfer means for drawing fluidized powder paint material from the plenum; and a purge ring mounted on said canister body exterior in fluid communication with said purge air apertures and adapted to be connected to a compressed air source for supplying purge air to the plenum.

2. The canister assembly according to claim 1 wherein said at least one powder material transfer means is a venturi pump.

3. The canister assembly according to claim 2 wherein said venturi pump is mounted on an exterior of said canister body and has a pump inlet extending through said wall of said canister body.

4. The canister assembly according to claim 2 wherein said inlet of said venturi pump has an oval shape.

5. The canister assembly according to claim 1 wherein said means for mixing the powder material includes a fluidizing plate disposed in said canister body and dividing said canister body plenum into an upper powder paint storage portion and a lower fluidization air plenum, and a fluidizing distribution plate disposed in said canister body intermediate said fluidization plate and a bottom of said canister body plenum, said fluidizing distribution plate having a plurality of holes formed therein for distributing fluidizing air received from a fluidizing air inlet in said bottom of said canister body plenum to a facing surface of said fluidizing plate.

6. The canister assembly according to claim 5 wherein said holes are formed in a circular pattern about a periphery of said fluidizing distribution plate.

7. The canister assembly according to claim 1 including a purge air outlet in fluid communication with the plenum.

8. The canister assembly according to claim 1 wherein said canister body is closed at an upper end by an upper plate having at least one inspection window formed therein.

9. A manifold for selectively connecting a plurality of powder material sources to a powder material component, comprising:

at least one modular manifold body having a passage formed therein adapted to be connected to at least one of a downstream modular manifold body, an upstream modular manifold body and a powder material component;

a pair of pinch valves attached to said manifold body and in fluid communication with said passage, each of said pinch valves adapted to be connected to a separate source of powder paint material and operated selectively between an open mode for powder material flow to said passage and a closed mode blocking powder material flow;

a second manifold body having a passage formed therein connected in fluid communication with a one end of said passage of said at least one modular manifold body; and an end cap connected in fluid communication with an opposite end of said passage of said at least one modular manifold body, said end cap adapted to be connected to a powder material component.

10. The manifold according to claim 9 wherein each said pinch valve has a generally tubular valve body with a collar member rotatably mounted thereon, each said collar member including a fitting adapted to be connected to a source of compressed fluid for operating said pinch valve between an open mode and a closed mode.

11. The manifold according to claim 10 wherein each of said pinch valves includes a membrane member disposed in said valve body and having an exterior surface in fluid communication with a passage formed in said fitting.

12. The manifold according to claim 11 wherein said membrane member is retained in said valve body by a tubular retaining collar surrounding said membrane member, said collar having a flange formed at each end thereof cooperating with a respective lip formed on said membrane member to prevent axial and lateral movement of said membrane member in said valve body.

13. The manifold according to claim 9 wherein each of said pinch valves has a first end including a push lock fitting for attachment to an inlet conduit.

14. The manifold according to claim 9 wherein each of said pinch valves includes a second end and has a purging spool attached to said second end.

15. A color changer and canister assembly for a powder paint material delivery and distribution system, comprising:

a substantially hollow canister body having a powder material inlet and a powder material outlet formed in a wall thereof;

a top plate and a bottom plate enclosing opposite ends of said canister body to define a plenum;

a color change manifold attached to an exterior surface of said canister body wall, said manifold including a plurality of module bodies each having a pair of pinch valve assemblies adapted to be connected to different sources of powder material;

a porous fluidization plate disposed in said canister body and separating said plenum into an upper portion and a lower portion, said powder material inlet and outlet being open to said upper portion;

a purge ring attached to said exterior surface of said canister body, said purge ring being in fluid communication with a plurality of apertures extending through said wall into said plenum upper portion for supplying compressed air to purge said plenum of powder material; and at least one powder material transfer venturi pump attached to said exterior surface of said canister body and having an oval inlet extending into said powder material outlet for drawing powder material from said upper portion.

16. The color changer and canister assembly according to claim 15 wherein each of said manifold bodies has a passage formed therein, said passages being in fluid communication with one another and wherein said manifold includes an end cap connected in fluid communication between said passages and said powder material inlet.

17. The color changer and canister assembly according to claim 15 wherein each said pinch valve assembly has a generally tubular valve body with a collar member rotatably mounted thereon, each said collar member including a fitting adapted to be connected to a source of compressed fluid for operating said pinch valve between an open mode and a closed mode.

18. The color changer and canister assembly according to claim 15 wherein at least one of said pinch valve assemblies is adapted to be releasably attached to the source of powder material.

19. The color changer and canister assembly according to claim 15 wherein said apertures are oriented in different axial directions with respect to a longitudinal axis of said canister body.

20. A manifold for selectively connecting a plurality of powder material sources to a powder material component, comprising:

at least one modular manifold body having a passage formed therein adapted to be connected to at least one of a downstream modular manifold body, an upstream modular manifold body and a powder material component; and a pair of pinch valves attached to said manifold body and in fluid communication with said passage, each of said pinch valves adapted to be connected to a separate source of powder paint material and operated selectively between an open mode for powder material flow to said passage and a closed mode blocking powder material flow, wherein each said pinch valve has a generally tubular valve body with a collar member rotatably mounted thereon, each said collar member including a fitting adapted to be connected to a source of compressed fluid for operating said pinch valve between said open mode and said closed mode, and each said pinch valve includes a membrane member disposed in said valve body and having an exterior surface in fluid communication with a passage formed in said fitting, said membrane member retained in said valve body by a tubular retaining collar surrounding said membrane member, said collar having a flange formed at each end thereof cooperating with a respective lip formed on said membrane member to prevent axial and lateral movement of said membrane member in said valve body.

21. The manifold according to claim 20 wherein said collar includes at least one aperture formed therein in fluid communication with said passage in said fitting, whereby when a compressed fluid is introduced to said passage and flows through said at least one aperture, the compressed fluid deforms the membrane member, moving said pinch valve from the open mode to the closed mode.

22. A manifold for selectively connecting a plurality of powder material sources to a powder material component, comprising:

at least one modular manifold body having a passage formed therein adapted to be connected to at least one of a downstream modular manifold body, an upstream modular manifold body and a powder material component; and a pair of pinch valves attached to said manifold body and in fluid communication with said passage, each of said pinch valves adapted to be connected to a separate source of powder paint material and operated selectively between an open mode for powder material flow to said passage and a closed mode blocking powder material flow, wherein each said pinch valve has a generally tubular valve body with a collar member rotatably mounted thereon, each said collar member including a fitting adapted to be connected to a source of compressed fluid for operating said pinch valve between said open mode and said closed mode, and each said valve body has a first end including a push lock fitting for attachment to an inlet conduit.

23. The manifold according to claim 22 wherein each said pinch valve includes a purging spool attached to a second end of said valve body.

24. A manifold for selectively connecting a plurality of powder material sources to a powder material component, comprising:

at least one modular manifold body having a passage formed therein adapted to be connected to at least one of a downstream modular manifold body, an upstream modular manifold body and a powder material component; and a pair of pinch valves attached to said manifold body and in fluid communication with said passage, each of said pinch valves adapted to be connected to a separate source of powder paint material and operated selectively between an open mode for powder material flow to said passage and a closed mode blocking powder material flow, wherein each said pinch valve has a generally tubular valve body with a collar member mounted therearound and rotatable relative thereto, and each said collar member includes a fitting mounted thereon and rotatable therewith and adapted to be connected to a source of compressed fluid for operating said pinch valve between said open mode and said closed mode.

* * * * *